United States Patent [19]

Blair

[11] Patent Number: 4,778,030

[45] Date of Patent: Oct. 18, 1988

[54] ESCAPE LINE CLAMP ASSEMBLY

[76] Inventor: Victor D. Blair, 1875 Michigan Ave., Marysville, Mich. 48040

[21] Appl. No.: 148,341

[22] Filed: Jan. 25, 1988

[51] Int. Cl.[4] ..... A62B 1/14; A62B 1/20

[52] U.S. Cl. ..... 182/5; 188/65.2

[58] Field of Search ..... 182/5, 6, 7, 193, 240; 188/65.1, 65.2, 65.5

[56] References Cited

U.S. PATENT DOCUMENTS

| | | | |
|---|---|---|---|
| 188,817 | 3/1877 | Pulaski | 182/7 |
| 287,856 | 11/1883 | Parsels | 182/193 |
| 330,103 | 11/1885 | Flietner | 188/65.1 |
| 632,692 | 9/1899 | Boehme | 182/5 |
| 738,785 | 9/1903 | Epperson | 182/193 |
| 976,861 | 11/1910 | Firestone | 188/65.1 |
| 1,169,760 | 2/1916 | Barrett | 182/6 |
| 3,504,763 | 4/1970 | Rabelos | 182/7 |
| 3,765,507 | 10/1973 | Rabelos | 182/5 |
| 3,834,489 | 9/1974 | Rabelos | 182/5 |
| 4,448,281 | 5/1984 | Adams | 182/5 |

*Primary Examiner*—Reinaldo P. Machado
*Attorney, Agent, or Firm*—Thomas N. Neiman

[57] ABSTRACT

According to one embodiment, the novel escape line clamp assembly comprises primarily as a brake on a fire escape line or rope. The assembly is comprised of a main body block which contains a vertical aperature for the line or rope to pass through. The main body block is divided into two sections bolted together and a slot is cut out of the external section of the main body block. A brake adjustment piece is inserted into the slot with a very close tolerance. A clamp is positioned around the main body of the block and the brake adjustment piece and a tensioning bolt is inserted into a horizontal aperature drilled into the clamp and into the brake adjustment piece. The tension is controlled by the amount of pressure the end of the bolt exerts on the brake adjustment piece against the fire escape line. Handles or harness connection rings are attached the clamp at the outer ends of the clamp.

6 Claims, 2 Drawing Sheets

ESCAPE LINE CLAMP ASSEMBLY

This invention pertains to fire escape apparatus and in particular to such fire escape apparatus which provides a simple fire escape line clamp assembly that allows for a reliable braking mechanism on a fire escape line allowing an individual easy egress from a multi-story building.

Fire escape devices currently cover the full gamut from folding stairs to collapsible ladders to units which are added on to the side of a building. These units tend to be acceptable and work properly, however they tend to be very cumbersome and expensive or they tend to be difficult to use. The expensive units are not frequently installed because of their costs or because they tend to be impractical in taller multi-story buildings. Many of smaller units are difficult to use and in the circumstances present in an emergency make them less than worthwhile. What is needed is a device that is simple and inexpensive to manufacture, can be easily installed at the proper location and is very easy to use in an emergency. What is needed is a device that can be preset to provide adequate support for the weight it will be required to deal with. It is also an object of this invention to teach a device that will provide the proper braking restraint to allow for safe egress in emergency situations.

It is the object of this invention, then, to set forth an escape line clamp assembly, for use in an emergency egress multi-story buildings such as hotels or elderly housing or the like, comprising a main body block; said main body block comprises split sections connected together; said main body block has a vertical aperature centrally positioned; said split sections have first means comprising an inner section, and second means comprising an outer section; said outer section has brake guide means; brake adjustment means; said brake adjustment means being inserted into said brake guide means; clamping means, for holding said assembly as a single unit; said clamping means has a horizontal aperture drilled through said means an into said brake adjustment means; tensioning means being positioned within said horizontal aperature, for allowing the desired pressure to be maintained on the egress line passing through the vertical aperature; and grasping means for permitting the user to hold or be connected to the clamping assembly.

Further objects of this invention, as well as the novel features thereof, will become more apparent by reference to the following description taken in conjunction with the following figures, in which.

Figure 1:
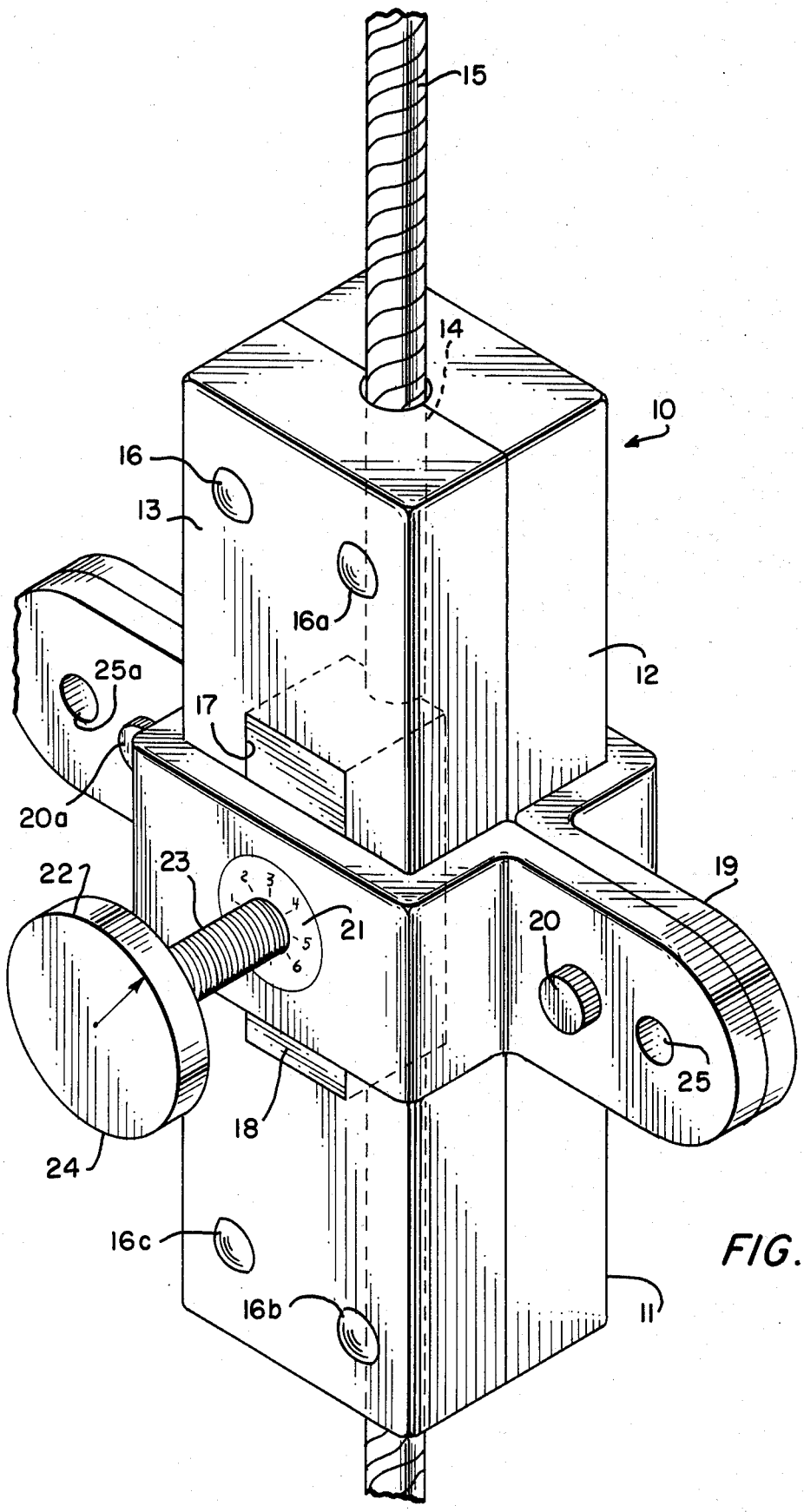
FIG. 1 is a side elevational view of the novel escape line clamp assembly in position on a fire escape line.
Figure 2:
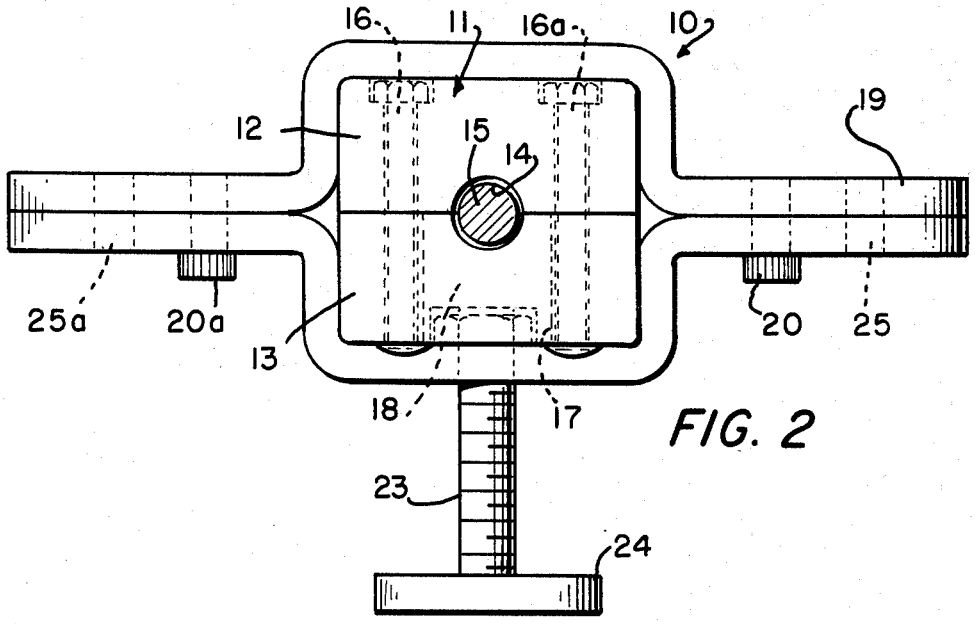
FIG. 2 is a top view thereof.
Figure 3:
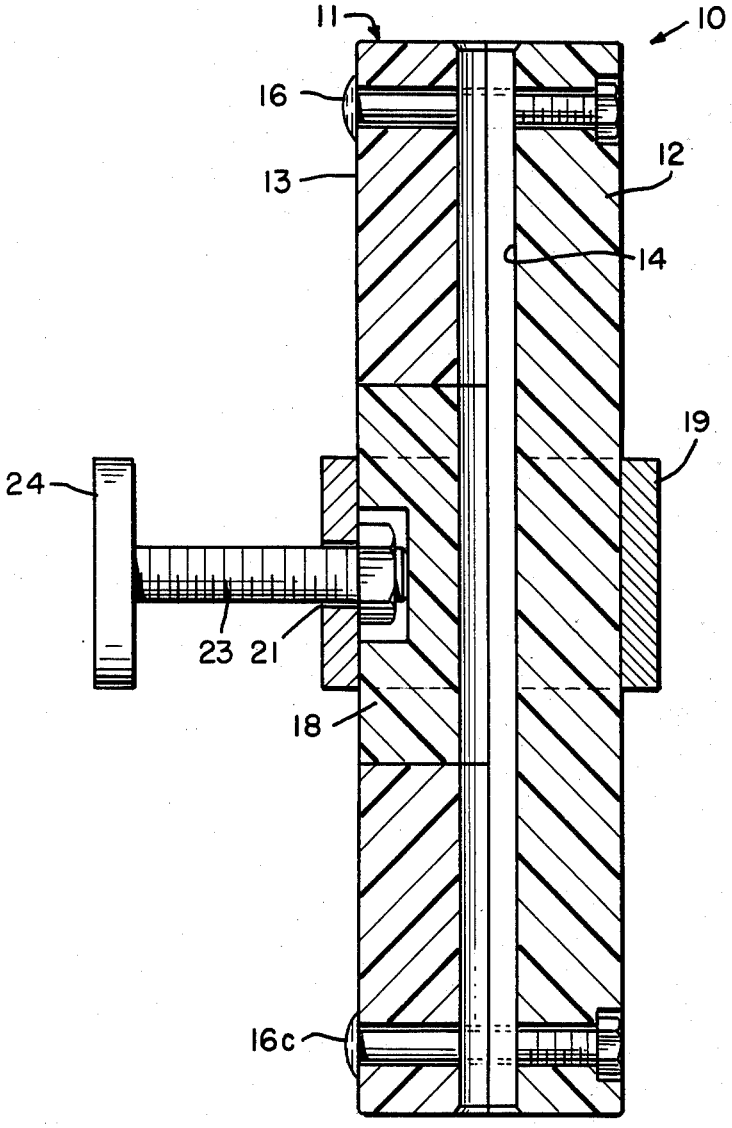
FIG. 3 is a side cross-sectional view without the line included to provide a clear view of the novel clamp assembly.

As shown in the figures, the novel escape line clamp assembly 10 comprises a main body block 11 that is devided into an inner section 12 and an outer section 13. The main body block 11 has a vertical aperature 14 that has been drilled into it at a position that is centrally located between the two sections. This aperature 14 allows the fire escape line 15 to pass through the main body block 11 of the escape line clamp assembly 10 and this opening is beveled on both ends. The inner section 12 and the outer section 13 are held together by bolt assemblies 16, **16*a*, 16*b* and 16*c*. A slot 17 is cut into the outer section 13 to provide a guide for the brake pad 18 which presses against the fire escape line 15. The main body block 11 then has a clamp 19 which is positioned around the body block covering the brake pad 18 and the guide slot 17. The clamp is held together by bolts 20 and 20*a*. A horizontal aperature 21 is drilled through the clamp 19 and into brake pad 18. It is most important that this aperature be centered to provide proper pressure. The tensioning assembly 22 comprises a rod 23 that is screwed into the horizontal aperature 21, through a nut that is tacked to the inside of the clamp 19 and against the brake pad 18. The rod is attached to a handle 24 that provides leverage to the user to be able to increase or decrease the pressure on the brake pad and thereby increase or decrease the tension against the fire escape line. This lined is marked to indicate the proper tensioning for the weight involved. The outer holes 25 and 25*a* in the clamp 19** are designed to attach a harness or the like to the escape line clamp assembly so that the user can attach himself or herself to the assembly.

In operation the escape line clamp assembly would be prepositioned with a fire escape line and the harness in the hotel room or elderly housing unit underneath the inside of the desired window. If a fire broke out, the user would get himself or herself into the harness, throw the line out the window and then let themselves down the line. The tension can be preset up to 500 pounds and the line is attached under the window. If more than one person was in the room, when the first user reached the ground they would undo the harness and the entire assembly would be pulled back up to the room. The line would then be retied and the unit is ready for use again.

While I have described my invention in connection with specific embodiments thereof, it is to be clearly understood that this is done only by way of example and not as a limitation to the scope of my invention as set forth in the objects thereof and in the appended claims.

I claim:

1. An escape line clamp assembly, for use in an emergency egress from multi-story buldings such as hotels or elderly housing or the like, comprising:

a main body block;

said main body block comprises split sections connected together;

said main body block has a vertical aperature centrally positioned;

said split sections have first means comprising inner section, and second means comprising an outer section;

said outer section has brake guide means;

brake adjustment means;

said brake adjustment means being inserted into said brake guide means;

clamping means, for holding said assembly as a single unit said clamping means has a horizontal aperature drilled through said means and into said brake adjustment means;

tensioning means being positioned within said horizontal aperature, for allowing the desired pressure to be maintained on the egress line passing through the vertical aperature; and grasping means for permitting the user to hold or be connected to the clamping assembly.

2. An assembly, according to claim 1, wherein:

said split sections of said main body block have a plurality of connecting means; and said connecting means comprises bolt assemblies.

3. An assembly, according to claim 1, wherein:

said brake guide means comprises a slot positioned in said outer section, for receiving in very close tolerances said brake adjustment means.

4. An assembly, according to claim 1, wherein:

said tensioning means comprises a screwable threaded rod which passes through said clamping means and against said brake adjustment means, for providing pressure against said egress line.

5. An assembly, according to claim 1, wherein:

said clamping means comprises a frame which envelopes said main body block;

said frame has an inner piece and a separate outer piece;

said inner piece and said outer piece having a plurality of joining means to form said inner and said outer piece into a single unit.

6. An assembly, according to claim 1, wherein:

said grasping means comprises openings placed at the opposite outer extensions of said clamping means, for permitting the installation of rings or hooking mechanisms for the user to hold onto or allow for a harness to be attached to.

* * * * *